United States Patent [19]

Fields

[11] Patent Number: 4,893,050

[45] Date of Patent: Jan. 9, 1990

[54] LAMP WITH A CAPTURED REFLECTOR AND METHOD OF MANUFACTURE

[75] Inventor: Larry R. Fields, Richmond, Ky.

[73] Assignee: GTE Products Corporation, Danvers, Mass.

[21] Appl. No.: 234,983

[22] Filed: Aug. 22, 1988

[51] Int. Cl.[4] ..... H01K 1/36; H01K 3/12

[52] U.S. Cl. ..... 313/113; 313/578; 313/623; 445/27; 445/32

[58] Field of Search ..... 313/113, 578, 579, 580, 313/315, 623; 445/27, 32

[56] References Cited

U.S. PATENT DOCUMENTS

| | | | |
|---|---|---|---|
| 654,208 | 7/1900 | Washburn et al. | 313/113 |
| 4,079,283 | 3/1978 | George | 313/113 |
| 4,150,316 | 4/1979 | Levin et al. | 313/113 |
| 4,703,220 | 10/1987 | Walsh | 313/580 |

*Primary Examiner*—Kenneth Wieder

*Attorney, Agent, or Firm*—William E. Meyer

[57] ABSTRACT

A lamp with an internal reflector is disclosed. The reflector includes an extension captured in the inner surface of the envelope to security position, and maintain the reflector position, without having extraneous support, bridge, or other internal fixtures to secure the reflector. The invention described reduces the need for support mechanisms, and allows the further reduction of lamp sizes for lamps having internal reflectors.

18 Claims, 1 Drawing Sheet

LAMP WITH A CAPTURED REFLECTOR AND METHOD OF MANUFACTURE

TECHNICAL FIELD

The invention relates to electric lamps and particularly to incandescent electric lamps. More particularly the invention is concerned with incandescent electric lamps with internal reflectors.

BACKGROUND ART

Electric lamps may at times include internal reflectors to shape and direct the light output. By placing the reflector inside the envelope, the reflector is securely and permanently oriented with respect to the filament. There are difficulties with internal reflectors. Reflectors have both size and mass that may interfere with the lamp assembly and filament operation. The reflector must not contact the filament electrically shorting, or mechanically distorting the filament. Sturdy support rods, bridge elements and other structures have therefore been used to control the reflector's position. The support structures are usually secured between two heavy support posts. An example of such internal support structures may be seen in U.S. Pat. No. 3,555,338 to Robert F. Scoledge et al for Incandescent Lamp showing an internal reflector supported on enlarged rods that have bridge elements connecting between the rods. U.S. Pat. No. 4,079,283 to Frederick J. George for High Wattage Incandescent Lamp with Support for a Planar Segmented Filament shows an internal reflector supported by an inner filament lead. The lead is an enlarged "spud" to support the reflector weight. U.S. Pat. No. 4,150,316 to Robert E. Levin et al for Incandescent Projection Lamp with Internal Reflector having Light Defining Opening Therein shows a three panel internal reflector mounted on support rods separated by two bridge elements.

As a result, the envelope requires additional space for the supports. Smaller lamps such as hard glass automotive lamps may contain internal reflectors but the small internal space frustrates deft positioning of the support mechanisms. There is then a need for internal lamp reflectors that do not rely on large support structures.

The lamp seal necessarily includes the electrical connections for the filament. The seal area is generally made small to allow a less expensive base, and a greater view of the filament. Inclusion of support, or other structures in the seal area invites electrical shorts to the reflector supports. Similarly, the envelope seal is weakened by large support members penetrating the seal. The support members likely have different coefficients of thermal expansion than does the envelope. The envelope and support members then do not seal well. The supports necessarily transmit the forces on the reflector to the seal. The forces work the seal, and act to separate the supports from the seal. There is then a need for a reflector support that does not weaken the seal.

A reflector to function ideally, needs to be properly positioned with respect to the filament. Ordinarily, the reflector orientation is kept by controlling the support rods during assembly, but controlling the support rods requires either additional design, labor, or machine precision. There is then a need for internal lamp reflectors that can be easily and accurately positioned during assembly.

DISCLOSURE OF THE INVENTION

An incandescent electric lamp with a captured reflector may be formed from a radiant energy transmissive envelope having an inner surface defining an enclosed volume, and a seal portion. An incandescent filament structure to generate radiant energy is positioned in the enclosed volume, whose electrical leads pass through the seal portion. A reflector, having a reflective surface positioned opposite the filament structure to reflect radiant energy generated by the filament includes a support projection captured in the inner surface of the envelope to securely fix the reflector with respect to the envelope. Additionally, contacts extending from the reflector may be made with the interior envelope surface to further align, and assist in supporting the reflector.

BEST MODE FOR CARRYING OUT THE INVENTION

Figure 1:
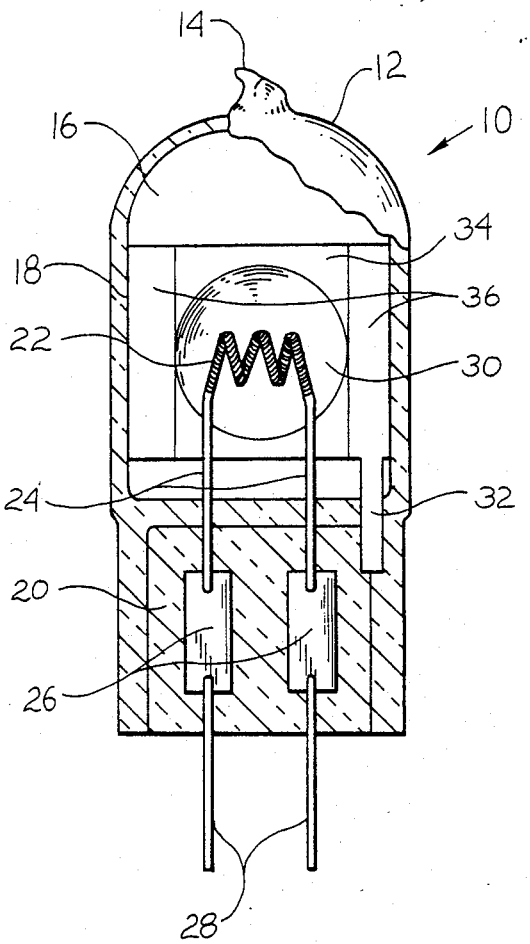
FIG. 1 shows a front view of a lamp with a preferred embodiment of a captured reflector.
Figure 2:
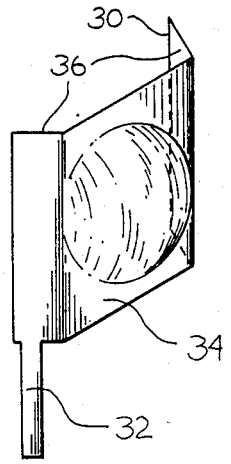
FIG. 2 shows an angled view from the side rear of a preferred embodiment of a three panel captured reflector with an anchor tab.

FIG. 1 shows a front view of a lamp 10 with a preferred embodiment of a captured reflector. The lamp 10 includes an envelope enclosing a filament, and a reflector in an enclosed volume. Filament leads extend out through the envelope by way of a press seal. The press seal may be partially surrounded by a lamp base.

The envelope 12 is formed from a radiant energy transmissive material that is melt formable. In particular the envelope 12 may be formed from quartz, or any number of glass compositions. In the preferred embodiment, the envelope 12 is tipped at one end 14, includes an enclosed volume 16 defined by an inner wall 18 in a central section. The enclosed volume 16 may include a special atmosphere, such as one of the inert or halogen type atmospheres known in the art. In the preferred embodiment, on an end opposite the tipped end 14 is a press seal 20. Tipping may also occur in the press seal 20 as is known in the art.

The envelope 12 is conveniently formed from a tubular section, although other suitable cross sectional configurations may be used. It is convenient that the inner wall 18 include accurately positioned wall portions that may be used for alignment. The parallel, accurately spaced inner wall of a tube provides an example, and is the preferred inner wall 18 embodiment.

A incandescent filament is positioned in the envelope 12 to generate radiant energy. A single tungsten filament coil 22 supported by two inner leads 24 is a convenient filament structure, although multiple filaments, and different support structures may be used. For a typical tungsten halogen lamp, the envelope material in the region of the press seal 20 encloses a portion of the inner leads 24. The inner leads 24 join with two foil sections 26. The foil sections 26 inturn join two outer leads 28. The envelope 12 may be heated in the area of the press seal 20 to a formable temperature, and then mechanically pressed around the inner leads 24, foil sections 26, and outer leads 28 to capture and seal the leads in the envelope material. Extending from the press seal 20, the two outer leads 28 are available for exterior electrical connection.

A portion of the press seal may be retained in an adaptive cavity shaped and positioned in a lamp base. No specific lamp base is a required element; however, the it is expected that the reflector lamp will likely be included in a ceramic lamp base of the type having a cavity for the press seal, and formed passages for the outer leads and conductive pins. The outer leads may follow the formed passages through the lamp base, and be soldered to the conductive pins for secure electrical connection. The conductive pins may act as sturdy, accurately positioned plug connectors for a socket. Other lamp base structures may be used, and in particular, a threaded lamp base, or a clip type support may be used.

Enclosed in the envelope 12 and in view of the filament is a precision formed reflector 30. Opposite the filament coil 22, to reflect the generated radiant energy is a reflective surface formed on the reflector 30. According to the particular purpose, the reflector 30 may have a defined surface to achieve a desired light pattern, as is known in the art. The reflector 30 may then have a spherical, parabolic, hyperbolic, elliptical, peened, speculated, dimpled, facetted or other specially selected surface features according to the users choice. The reflector 30 is conveniently formed from a resilient material, such as a sheet of metal. Flexible metal sheet allows convenient stamping of the defined surface for the desired light pattern.

Projecting from the reflector 30 and captured in the inner wall 18 is a support projection in the form of an anchor tab 32. The reflector 30 is then securely located with respect to the filament coil 22 by the captured anchor tab 32. In the preferred embodiment, the anchor tab 32 is formed as an elongated rectangular projection from the same piece forming the reflector 30. Alternatively, the projection may be formed from a separate piece welded or mechanically coupled to the reflector 30. A welded or coupled anchor tab 32 allows a separate specification of the reflector 30 and anchor tab 32 materials. Also, refined preprocessing of the reflector 30 and anchor tab 32 for each element may be made, such as coating, shaping, polishing, tempering or other treatments.

A portion of the inner wall 18 captures and holds the anchor tab 32. In the preferred embodiment, the anchor tab 32 parallels the inner leads 24, but is sufficiently offset from the inner leads 24 to be electrically isolated. The inner leads 24 and the anchor tab 32 then extend into the region where the press seal 20 is formed. The inner leads 24 and anchor tab 32 are then simultaneously captured in the envelope material when the press seal 20 is made. Alternatively, several anchor tabs may be formed, with each anchor tab extending into the press seal. The anchor tab may, in a further alternative, be designed to extend into the tip off, or into a specially formed portion of the envelope 12 designed to securely capture the projecting anchor tab 32. Since the anchor tab 32 does not pass through the press seal, there is no possibility of a leak forming along the anchor tab 32, and the press seal is not weakened by any support structure. Also, since the reflector 30 is not supported by the filament structure, it is unlikely the filament structure can be injured during manufacture, transport or final use by the weight of the reflector 30.

The reflector 30 may additionally have one or more positioning portions to assist in either initially orienting the reflector 30 during assembly, or in assisting to preserve the anchored position of the reflector 30. Where the reflector is formed from a resilient material, the reflector 30 may further include flexible contacts abutting accurately positioned alignment portions on the inner wall 18. Separate positioning or load bearing springs might alternatively be included between the envelope 12 and the reflector 30.

In the preferred embodiment, the reflector 30 is formed from a sheet of metal with three parallel panel sections. A defined surface for the reflector 30 in the form of a spherical section is stamped in a center panel 34. On either side of the reflector 30 panel are two wing panels 36. The wing panels 36 are angled with respect to the reflector 30 panel allowing the wing panels 36 to be folded in the direction of the center panel 34 creating a spring tension between the three panels. The two wing panels 36 have edges that parallel and axially contact the interior surface of the tubular envelope. On being inserted in the envelope 12, the three panel reflector 30 is slightly compressed. The inner wall 18 then assists in aligning the reflector 30 by the coaction of the spring force of the two wing panels 36. The anchor tab 32 is formed as a rectangular extension of one of the wing panels 36. Locating the anchor tab 32 on the extreme end one of the wings 40 has been found to limit interference between the inner leads and the anchor tab. Should the closer of the two inner leads short to the reflector 30 by way of the anchor tab 32, the remaining portions of the reflector 30 are sufficiently offset form the filament coil 22 and second inner lead to prevent a short circuit. Alternatively, several anchor tabs might be formed on either or both of the remaining panels. The reflector 30 is conveniently positioned and held in place until the press seal 20 is formed around the anchor tab 32 by the coaction of the two wing panels 36. Once the anchor tab 32 is enclosed in the press seal 20, the three panel reflector 30 is felt to be securely fixed by the press seal 20 capturing the anchor tab 32. Nonetheless, the reflector 30 may continue to be Partially held in place by the assisting wing panels 36.

The construction of lamp with a reflector securely positioned in the envelope between the filament structure and the inner wall a reflector may proceed according to the following steps: Any included spring portions of the reflector are compressed. The reflector with an anchor tab is positioned in a shaped envelope so the anchor tab extends into a region of the envelope to be closed, allowing any included spring portions of the reflector to extend to contact any alignment portions of the inner surface of the envelope to stabilize the reflector position. A spring compression acting across the reflector and between at least two portions of the inner surface of the envelope is thereby formed to position and hold the reflector prior to closing the envelope. A filament structure is positioned in the envelope so the filament coil is adjacent the reflector, and the filament leads extend through a region to be closed. The envelope regions to be closed are heated to a formable temperature. The heated envelope regions are then press formed so the envelope material around the filament leads and the anchor tab mechanically captures the filament leads and anchor tab in the envelope material. As a result the reflector is then securely positioned in the envelope between the filament structure and the inner wall by the press seal capturing the anchor tab. The coaction between the inner wall and the resilient wing panels stabilizes the reflector.

In a working example some of the dimensions were approximately as follows: A 1.0 cm diameter clear tubular quartz envelope was press sealed and tipped to form an enclosed volume about 1.0 cm long. A tungsten coil filament with three secondary coils transverse to the tube axis was centrally positioned in the enclosed volume, and supported by two inner leads. The inner leads connected to molybdenum foils which inturn connected to outer leads. The inner leads, foils, and outer leads were captured in a 1.5 cm press seal. A three panel reflector was positioned between the coil filament and the inner wall to reflect substantially all the light from one side of the coil. The reflector included an anchor tab about 2.0 mm wide and 5.0 mm long projected from one of the two wing panels, and extended parallel to one of the inner leads into the press seal. The two wing panels contacted the envelope wall to further stabilize the reflector. A working lamp was implemented with the above reflector with an anchor tab design. The lamp, a 20 watt, 18 volt lamp in a T3.0 size glass, was constructed with stamped molybdenum reflector with a captured anchor tab. All of the reflectors were securely held by the anchor tab. The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A press sealed incandescent electric lamp with a captured reflector comprising:

(a) a radiant energy transmissive envelope having an inner surface defining an enclosed volume, and a press seal portion, (b) an incandescent filament structure to generate radiant energy positioned in the enclosed volume, and having electrical leads passing through the press seal portion, and (c) a reflector, having a reflective surface positioned in the enclosed volume, opposite the filament structure to reflect radiant energy generated by the filament, including a support projection captured in the inner surface of the press seal.

2. The apparatus in claim 1, wherein the envelope is formed from fused quartz.

3. The apparatus in claim 1, wherein the filament structure includes a tungsten coil supported by two inner leads.

4. The apparatus in claim 1, wherein the reflector includes a curved surface reflector portion.

5. The apparatus in claim 4, wherein the curved surface reflector portion is a spherical section.

6. The apparatus in claim 4, wherein the curved surface reflector portion is a parabolic section.

7. The apparatus in claim 4, wherein the curved surface reflector portion is a hyperbolic section.

8. The apparatus in claim 4, wherein the curved surface reflector portion is a elliptical section.

9. The apparatus in claim 1, wherein the reflector includes a flexible contact portion abutting the inner surface of the envelope.

10. The apparatus in claim 9, wherein the reflector includes two flexible contact portions abutting opposite positions along the inner surface of the envelope to generate a compression force between the two contact portions.

11. The apparatus in claim 10, wherein the reflector includes two flexible contact portions on opposite sides of the curved reflector portion, and abutting opposite positions along the inner surface of the envelope to generate a compression force between the two contact portions.

12. The apparatus in claim 1, wherein the support projection captured in the inner surface is captured in the press seal portion of the envelope.

13. The apparatus in claim 12, wherein the support projection captured in the inner surface is an extension of the contact portion.

14. The apparatus in claim 10, wherein each contact portion includes a support projection captured in the inner surface of the envelope.

15. A press sealed incandescent electric lamp with a captured reflector comprising:

(a) a radiant energy transmissive envelope having an inner surface defining an enclosed volume, the envelope also having a press seal portion, (b) an incandescent filament structure to generate radiant energy positioned in the enclosed volume, and having electrical leads passing through the press seal portion, and (c) a reflector positioned in the enclosed volume opposite the filament structure to reflect radiant energy generated by the filament, the reflector being formed from three panels, having a reflective surface formed in a center panel, two flexible wing panels on opposite sides of the central panel and abutting the inner surface of the envelope, and an anchor tab formed as an extension of one of the wing panels captured in the inner surface of the press seal.

16. A method of manufacturing press sealed incandescent lamp with an included reflector comprising the steps of:

(a) positioning a filament structure in a light transmissive envelope, (b) positioning a reflector with a projecting foot intermediate the filament structure and the envelope structure with the projecting foot in the region of the filament leads of the filament structure, (c) heating the envelope to a formable temperature, (d) forming the envelope material around the filament ends to press seal the filament ends in the envelope material, p1 (e) forming the envelope material around the reflector projection to mechanically fix the reflector projection in the press seal envelope material, (f) filling the enclosed volume with a defined atmosphere, and (g) closing the envelope to seal the defined atmosphere.

17. The method in claim 16, wherein the steps of forming the envelope material around the filament ends, and forming the envelope material around the reflector projection occur simultaneously.

18. The method in claim 16, further including the step forming a spring compression acting across the reflector and between at least two portions of the inner surface of the envelope to position the reflector prior to forming the envelope material around the reflector projection.

* * * * *